United States Patent [19]

Hrdlička

[11] 4,333,378

[45] Jun. 8, 1982

[54] DEVICE FOR SUPPORTING A MUSICAL INSTRUMENT

[76] Inventor: Alois Hrdlička, Zürcherstrasse 135, CH-8406 Winterthur, Switzerland

[21] Appl. No.: 213,165

[22] Filed: Dec. 4, 1980

[51] Int. Cl.[3] ..... G10G 5/00

[52] U.S. Cl. ..... 84/280

[58] Field of Search ..... 84/278, 280

[56] References Cited

U.S. PATENT DOCUMENTS

| | | | |
|---|---|---|---|
| 932,844 | 8/1909 | Beisheim | 84/280 |
| 3,631,754 | 1/1972 | Kun | 84/280 |
| 3,727,509 | 4/1973 | Henkle | 84/278 |

FOREIGN PATENT DOCUMENTS

| | | | |
|---|---|---|---|
| 343111 | 10/1921 | Fed. Rep. of Germany | 84/280 |

*Primary Examiner*—Lawrence R. Franklin

*Attorney, Agent, or Firm*—Burns, Doane, Swecker & Mathis

[57] ABSTRACT

A supporting device for a stringed musical instrument is disclosed. The device has a support member whose ends are provided with clamping means and rest means for resting the instrument on the body of a musician. The rest means is connected to the support member by locking means which selectively locks the support member with respect to the rest means. The device is preferably adjustable in height and width, and is formed to be tiltable. The clamping means preferably engage the instrument in the region of a rib on an edge portion of the instrument. During use of the supporting device, a change in the position of the instrument does not cause a change in the position of the rest means, so that a player is to a large extent freed from strain while holding the instrument.

17 Claims, 3 Drawing Figures

DEVICE FOR SUPPORTING A MUSICAL INSTRUMENT

BACKGROUND AND SUMMARY OF THE PRESENT INVENTION

The present invention relates to devices for supporting musical instruments.

The invention is particularly, but not exclusively, suitable for use in supporting a violin or other such stringed instrument between the chin and shoulder of a musician. The device is preferably used for supporting the instrument on the shoulder of the musician. The instrument may also be provided with a chin support in the usual manner.

Shoulder supports for stringed musical instruments, for example violins, violas and the like are known, in which a holding bridge under the back of the instrument is provided. The holding bridge is connected with a padded support plate or rest plate by way of elastically resilient means which are formed in such a way that the rest plate is flexible in all directions with respect to the holding bridge.

This arrangement is disadvantageous because movement about a vertical axis of the instrument or lateral inclination of the instrument is only possible to a limited extent. Also, this arrangement is not formed so as to tilt in an axial direction of the spring-mounted adjustment device.

A further disadvantage is that the spring-mounted means do not enable a permanent adjustment of the instrument's position. Furthermore, any change in the instrument position from the optimum position to which it is originally adjusted also requires a change in the position of the rest plate, so that the player is often subject to a relatively high degree of strain while holding the instrument and playing.

For the above reasons, the known support devices do not enable any individual adaptation of the rest plate to the anatomy of the musician.

An object, therefore, of the present invention is to provide a device which ensures a contact, between the body and the rest plate, to be as immobile as possible in any playing position of the instrument. The device provides a pre-requisite for an anatomical adaptation of the rest plate contact surface, which ensures in particular that the chin region and the arm are relaxed and unstrained while holding the instrument in any playing position.

The present invention includes a device for supporting a musical instrument on the body of a musician. The device has a support member provided with clamping means at each end thereof for clamping said member to respective edges of the musical instrument. The support member is preferably shaped to lie adjacent to the back of the instrument when clamped thereto in use. Rest means, preferably a rest member or rest plate is adjustably connected to the support member by locking means which selectively locks the support memeber in a particular orientation with respect to the rest means. The locking means is preferably a selectively lockable universal joint for example, a ball and socket joint.

An advantage of the described supporting device is that a change in the playing position of the instrument does not involve a change of the support plate position. This is a result of the use of the ball and socket joint between the rest member and the support member, thus ensuring that the strain on the player while holding the instrument is reduced.

A further advantage is that change in position of the instrument, independently of the support plate, may be provided for any desired or customary position by adjustment of the ball and socket joint. The ball and socket joint may be fixed in a known way by rotating the head via a locking screw, and the instrument position may be locked by hand without moving the instrument and without putting a bow for the stringed instrument down even during very short pauses in play.

The supporting device can be carefully fastened to all usual instruments, and it is possible to adapt the instrument position to the customary playing positions of the musician.

As a result of the arrangement of component parts of the supporting device, in particular as a result of the positioning of the rest member independently of the position of the support member, a basic positioning of the rest member is possible. The rest member may be substantially adapted to the anatomy of the player, as a result of which the chin region and the arm of the player are not strained and therefore are less prone to cramping.

BRIEF DESCRIPTION OF THE DRAWINGS

In order that the invention may be well understood a preferred embodiment thereof will now be described, by way of example only, with reference to the accompanying drawings wherein like members bear like reference numerals and wherein.

DETAILED DESCRIPTION OF A PREFERRED EMBODIMENT

Figure 1:
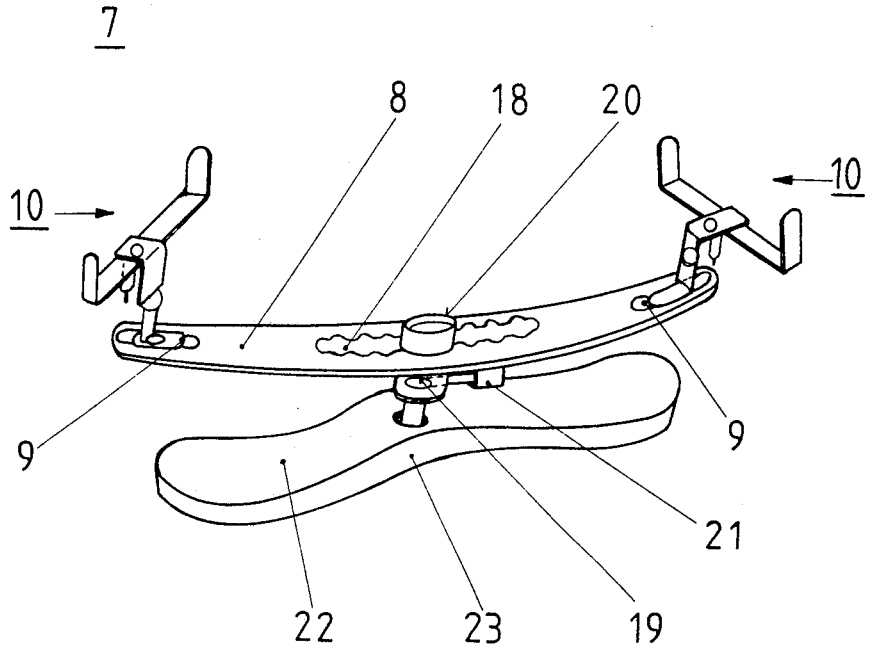
FIG. 1 is a perspective view of a device for supporting a musical instrument.
Figure 3:
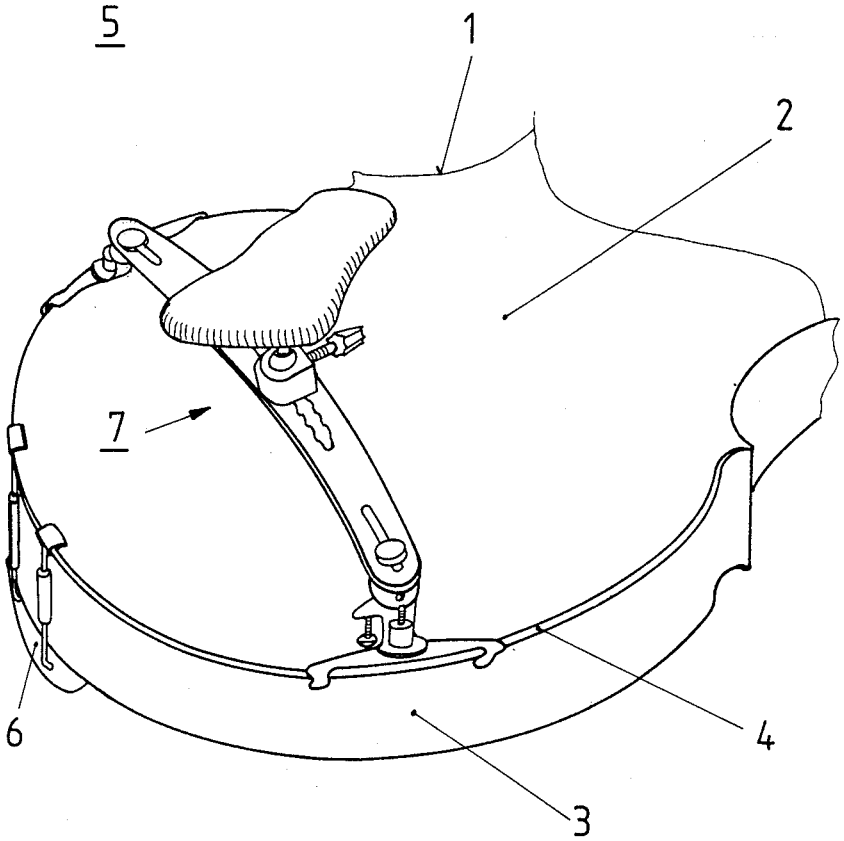
FIG. 3 is a perspective view of part of an instrument with the supporting device of FIG. 1 fixed thereto.

With reference to FIGS. 1 and 3, a holding device 7 for supporting a musical instrument 1 comprises a slightly curved support member or support 8 which extends preferably substantially parallel to an outer contour of a back 2 of the instrument 1. The support 8 may be made from a material of the same type as the instrument such as wood, plywood, or metal or any other material which does not impair the tone of the instrument. The support 8 has fixing means 10 disposed at each of its ends to hold the support 8 on the instrument 1.

Figure 2:
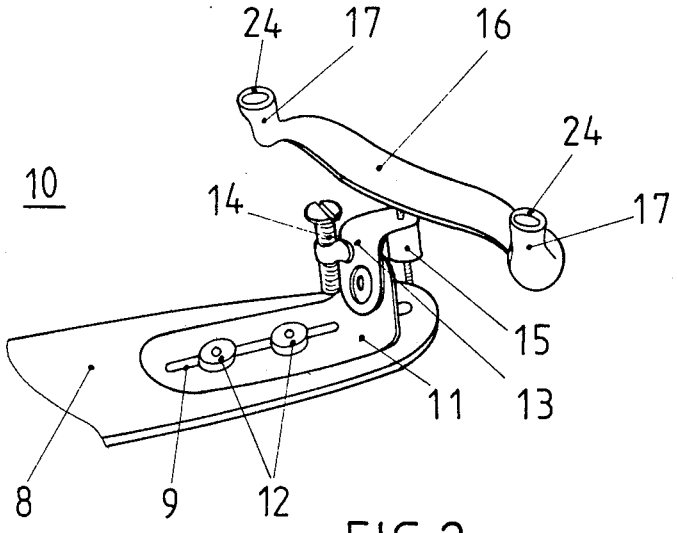
FIG. 2 is an enlarged perspective view of an end portion of the device of FIG. 1.

With reference now also to FIG. 2, each of the fixing means preferably has clamping means formed as two holding clamps 17 which serve to fix the holding device 7 to a rib 4 at a respective edge 3 at the back 2 of the instrument 1. The clamps 17 are formed at either end of a tiltable member 16 one of which is mounted on each end of the support member 8 by bracket means preferably a two-part bracket or elbow joint having a first bracket part 11 and a second bracket part 13. One or both of the fixing means 10 may be axially displaced and locked on the support 8, for example, by a slot-shaped aperture 9 in the first bracket part 11, so that the holding device 7 may be adpated to the particular width of the instrument. The curvature of the support 8 may also be formed non-parallel to the back of the instrument, so that the support 8 may be turned over through 180° as required. Therefore, the curved support 8 may be used convexly or concavely relative to the back 2 of the instrument 1 thus providing a greater scope for individual adaptation of the instrument position by the player.

With reference now again to FIG. 1, a universal joint, preferably a ball and socket joint 19, is longitudinally displaceable in a guide slot 18 in the center of the support 8 and may be axially displaced and locked at a set distance from support 8 by an adjustable screw 20. The ball and socket joint is connected to a rest plate or rest member 22. The rest plate 22 consists of a material which may be adapted to the anatomy of the musician and which retains that particular shape. The surface of the rest plate 22 which is adjacent to the body of the player is preferably provided with a resilient, non-slip covering 23. The rest plate 22 may, for example, consist of materials which may be readily deformed and are dimensionally stable and which may be adapted in a shape-retaining manner to the individual body curvature of the anatomy of the player.

The instrument 1 may be adjusted and locked manually in any desired playing position corresponding to the customary positioning of the instrument by the musician, by setting the ball and socket joint 19 in a simple manner in a very short time, even during very short pauses in playing, without moving the instrument 1 and without putting down a bow used for playing the instrument. Locking and release of the positioning is preferably carried out by rotating the head of the ball and socket joint 19 by a locking screw 21. The ball and socket joint 19 may also be locked by way of a lever clamp.

With reference again to FIG. 2, at least one of the bracket means is axially displaceable and lockable on the support 8 in the slot 9 of the first bracket part 11 by the use of two adjustable screws 12 for example. The second bracket part 13 has an adjustable stop screw 14 provided thereon. The first and second bracket parts 11, 13 may be connected together, for example, by a rivet connection in such a way that the second bracket part 13 may be tilted by the rivet connection and the tilting movement may be confined by the adjustable stop screw 14. At an end of the second bracket part 13 opposite to the rivet connection there is provided a screw connection 15 which is connected to the tiltable member or element 16, the tiltable member 16 being adjustable in height by means of the screw connection 15. The tiltable member 16 has holding clamps 17 disposed at both of its ends. The holding clamps 17 may also be formed to be adjustable in width (not shown) with respect to the tiltable member 16. Each holding clamp 17 consists of a slightly deformable material, for example of light metal. Preferably, the tiltable member 16 and the holding clamps 17, or at least the holding clamps 17 are provided with a protective covering 24, for example of rubber, leather or the like, in order to ensure careful attachment of the holding device 7 to the instrument 1. The holding clamps 17 are formed in such a way that they engage in the region of the rib 4 of the edge 3 at the back 2 of the instrument 1 and follow its contours.

In the case of an optimal adjustment of the fixing means 10 to the instrument 1, the position of the support 8 relative to the rest plate 22 and the position of the surface of the rest plate 22 relative to the body of the player, and also a suitable selection of material which does not impair the tone of the instrument, (in particular for the support 8), it is possible to attain an improved tone of the instrument as compared with known holding devices.

The holding device described and shown in the drawing may also be formed as a single constructional unit with a chin rest 6 known per se.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention.

What is claimed is:

1. A device for supporting a musical instrument on the body of a musician, the device comprising:

rest means for resting the instrument on the body of the musician;

a support member;

clamping means at each end of said support member for clamping respective edges of the musical instrument, said clamping means spacing said support member away from the musical instrument; and locking means for selectively locking said support member in a particular orientation with respect to said rest means said locking means including only one selectively lockable universal joint disposed between and connected to said support member and said rest means.

2. The device of claim 1 wherein said locking means includes a selectively lockable universal joint.

3. The device of claim 1 wherein said locking means is arranged so as to be axially displaceable and lockable in said support member at a set distance from said support member.

4. The device of claim 1, wherein each clamping means comprises two holding clamps.

5. The device of claim 4, wherein the ends of the holding clamps are adapted to engage a rib at an edge of the instrument, and wherein the clamps include a deformable material.

6. The device of claim 1 wherein the clamping means are mounted on respective bracket means carried by the support member.

7. The device of claim 6, wherein the bracket means comprise means for adjusting the height of the clamping means and means for tilting the clamping means in a first direction and adjustably preventing tilting in a second direction.

8. The device of claim 1 wherein the support member is shaped to lie adjacent to a rear surface of the instrument when the support member is clamped thereto.

9. The device of claim 8 wherein the support member during use is arranged to be convex relative to the back of the instrument.

10. The device of claim 8 wherein the support member during use is arranged to be concave relative to the back of the instrument.

11. The device of claim 8 wherein the support member during use is arranged to be substantially parallel to the back of the instrument.

12. The device of claim 1 wherein the rest means includes an elongated member which is made of a material adaptable to the anatomy of a musician and which material retains a particular shape.

13. The device of claim 12 wherein the surface of the elongated member is adpated to lie adjacent to the body of the musician and is provided with a resilient, non-slip covering.

14. A device for supporting a stringed musical instrument on the body of a musician, the device comprising:

a support member which is spaced from an outer contour of a back of the instrument;

a selectively pivotable bracket assembly provided at each end of the support member;

a tiltable member connected to each bracket assembly;

at least one holding clamp provided on each tiltable member, said holding clamps securing the support member to the instrument;

a rest member for resting the instrument on the body of the musician; and only one selectively lockable ball and socket joint adjustably connecting the rest member to the support member.

15. The device of claim 14 further comprising:

first adjusting means for adjusting each of said bracket assemblies axially with respect to said support member;

second adjusting means for adjusting a height of each tiltable member with respect to its bracket assembly;

third adjusting means for adjusting an angle through which said tiltable member can be tilted wherein the instrument can be pivoted on said tiltable members with respect to said rest member and said support member around said bracket assemblies away from the musician and said bracket assemblies being pivotable towards the musician to a selected angle; and fourth adjusting means for adjusting an axial displacement of said ball and socket joint with respect to said support member.

16. A device for supporting a musical instrument on the body of a musician, the device comprising:

rest means for resting the instrument on the body of the musician;

a support member for supporting the instrument, said support member being spaced away from said rest means;

clamping means at each end of said support member for clamping respective edges of the musical instrument said clamping means spacing said support member away from the instrument, said clamping means including a selectively pivotable bracket by which bracket said instrument may be pivoted away from the musician but is prevented from being pivoted towards the musician past a selected angle;

only one universal joint connecting the support member to said rest means; and a manually adjustable locking screw for selectively locking said universal joint in any of a plurality of positions.

17. The device of claim 16 wherein the universal joint is a ball and socket joint.

* * * * *